US005845987A

United States Patent [19]

Painter

[11] Patent Number: 5,845,987

[45] Date of Patent: Dec. 8, 1998

[54] ILLUMINATED ACCESSORY AND DEVICE

[76] Inventor: John M. Painter, 926 N. Florida Ave., Deland, Fla. 32720

[21] Appl. No.: 729,809

[22] Filed: Oct. 8, 1996

[51] Int. Cl.[6] ..... F21L 7/00

[52] U.S. Cl. ..... 362/206; 362/105; 362/106; 362/84; 362/189; 362/194

[58] Field of Search ..... 362/206, 105, 362/106, 84, 189, 194; 363/16, 18, 19, 20

[56] References Cited

U.S. PATENT DOCUMENTS

| | | | |
|---|---|---|---|
| 4,667,274 | 5/1987 | Daniel | 362/106 |
| 4,827,384 | 5/1989 | Von Schlemmer | 362/106 |
| 4,991,068 | 2/1991 | Mickey | 362/106 |
| 5,111,366 | 5/1992 | Rife et al. | 362/31 |
| 5,147,129 | 9/1992 | Ku | 362/106 |
| 5,327,587 | 7/1994 | Hurwitz | 2/422 |
| 5,329,637 | 7/1994 | Walker | 2/5 |
| 5,404,593 | 4/1995 | Kronenberger | 2/195.1 |
| 5,463,538 | 10/1995 | Womack | 362/106 |
| 5,479,325 | 12/1995 | Chien | 362/105 |
| 5,485,358 | 1/1996 | Chien | 362/106 |
| 5,559,680 | 9/1996 | Tabanera | 362/106 |
| 5,567,040 | 10/1996 | Tabanera | 362/108 |

*Primary Examiner*—Ira S. Lazarus
*Assistant Examiner*—David B. Lee

[57] ABSTRACT

An illuminated accessory and device including a hat that has a panel attached to the front section of the crown of the hat. The panel has indicia formed from a silk-screened polymer film overlay. The panel is formed of a flat electroluminescent lamp that has the shape of the indica and provides illumination. The lamp has a ribbon extension to a female connector. Included is an inverter positioned within the pouch of the crown of the hat. The inverter has a male connector at one end to couple with the female connector of the lamp. The inverter is in connection with a switch and power source. The inverter is adapted to supply AC line current from the power source to the panel for illumination of the indicia. Alternative embodiments of the present invention are also enclosed.

1 Claim, 9 Drawing Sheets

FIG. 3
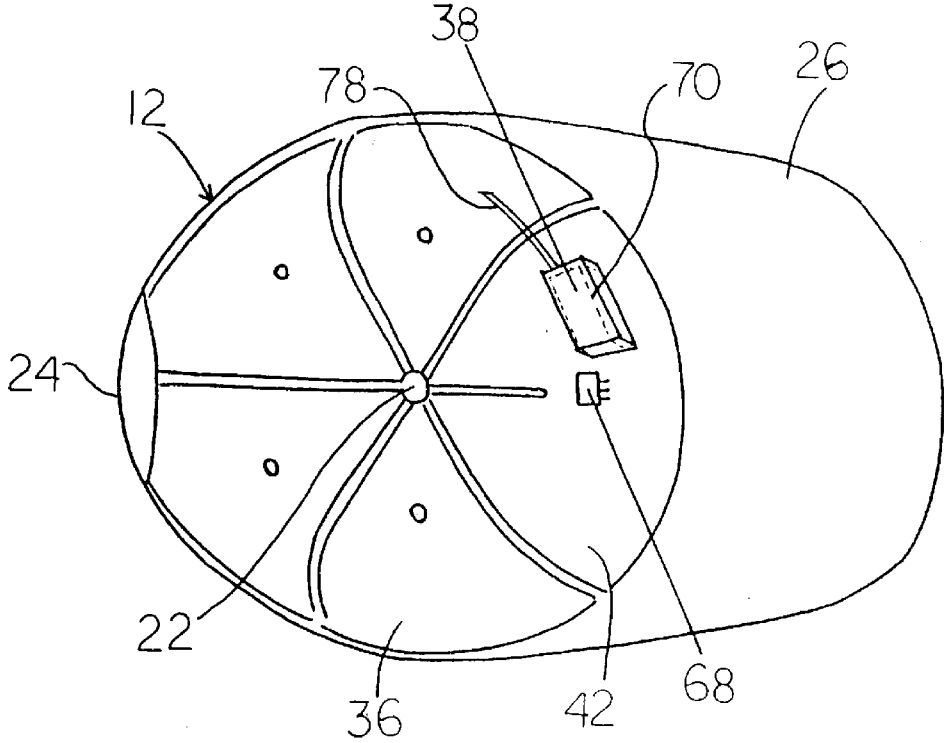
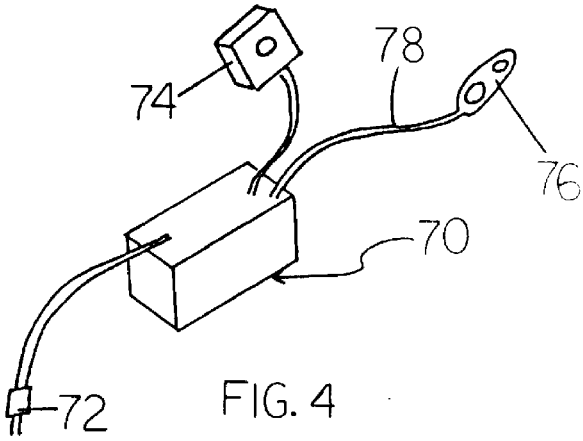
FIG. 4
FIG. 5
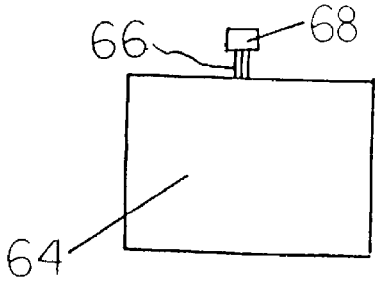

FIG. 11
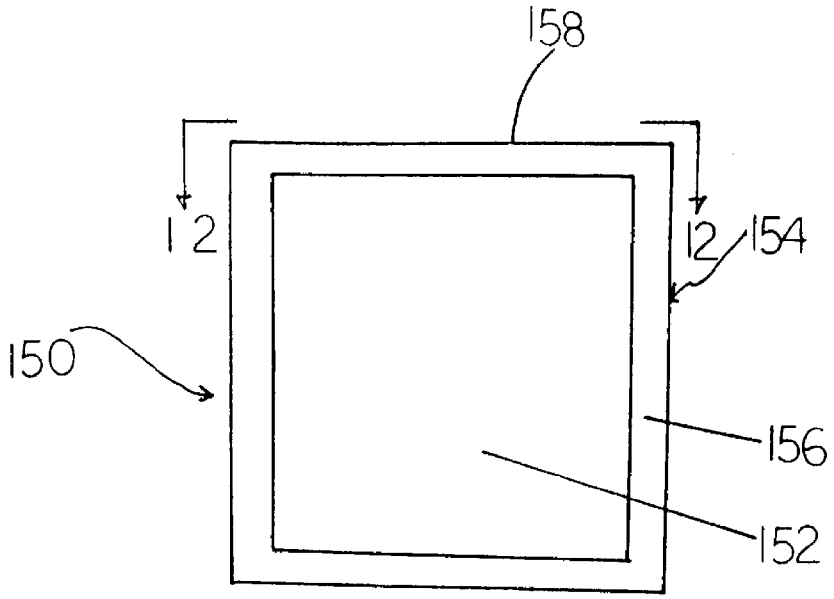
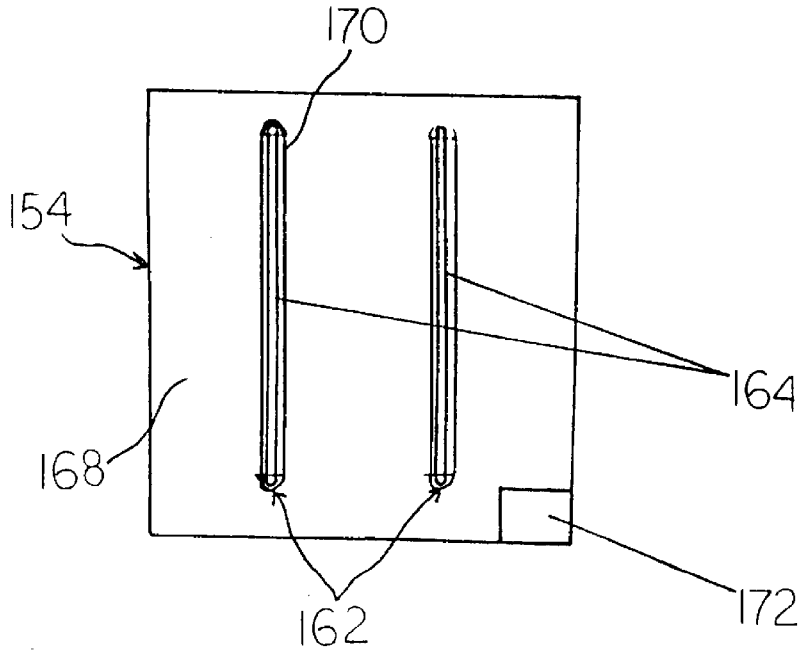
FIG. 12

FIG. 13
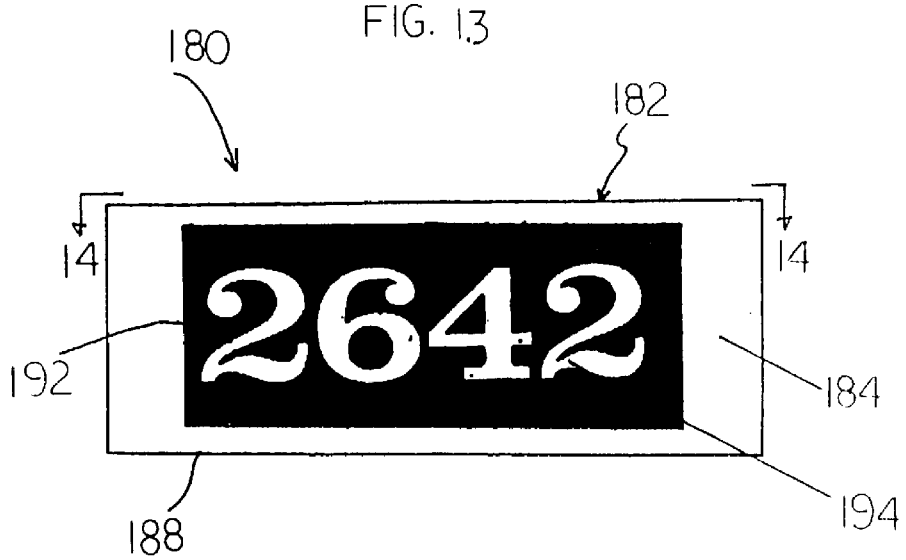
FIG. 14
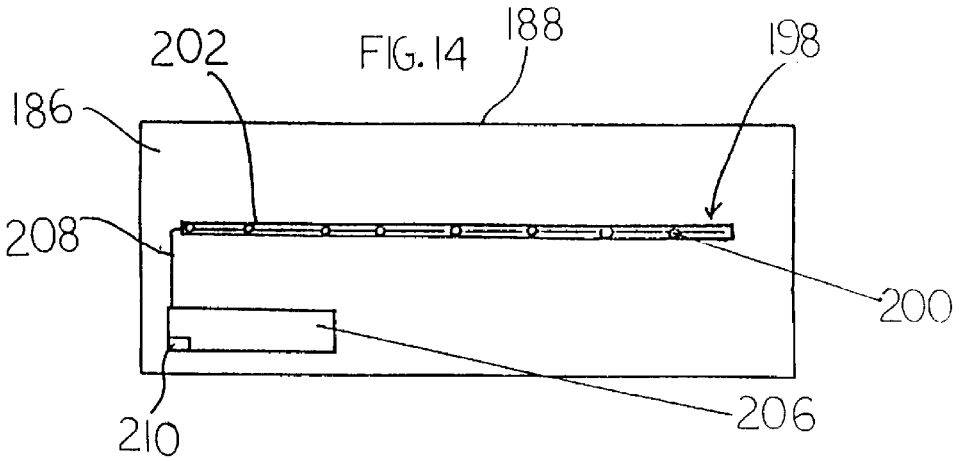
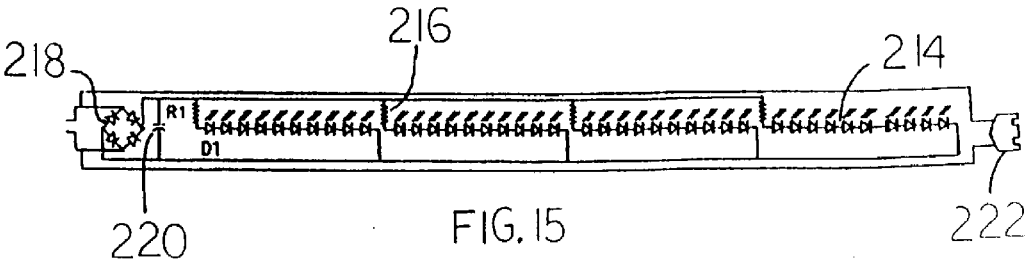
FIG. 15

FIG. 16
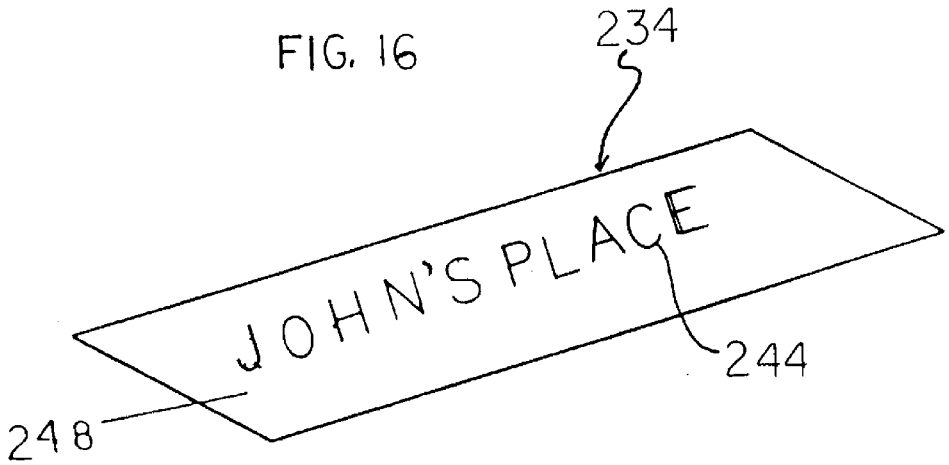
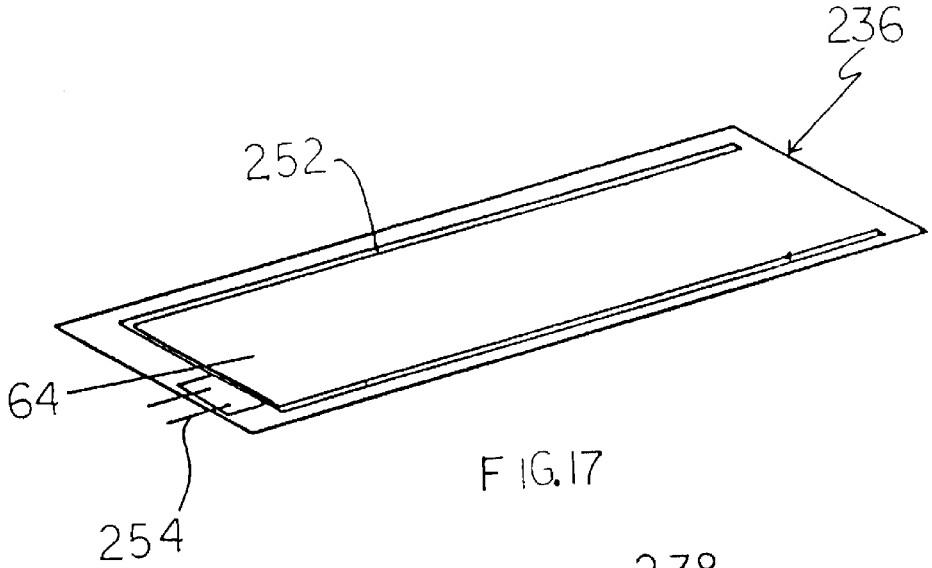
FIG. 17
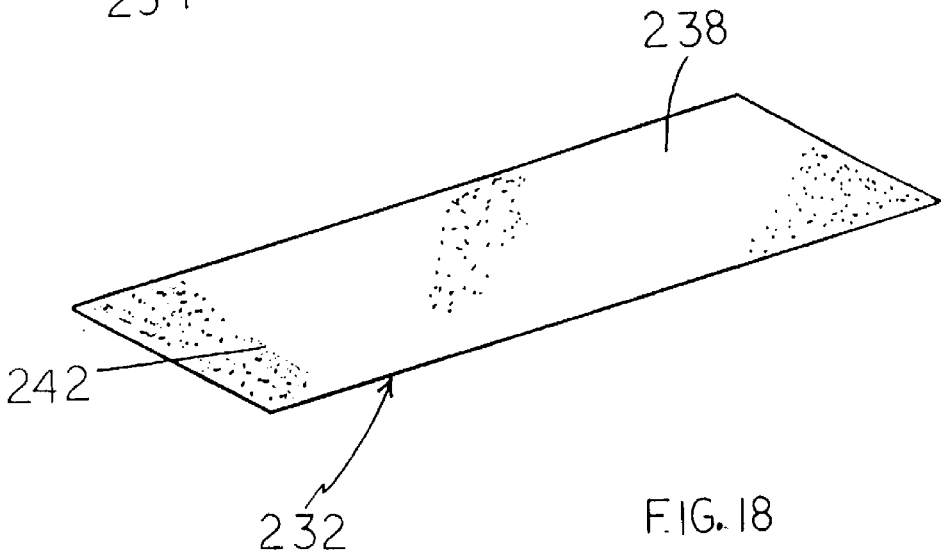
FIG. 18

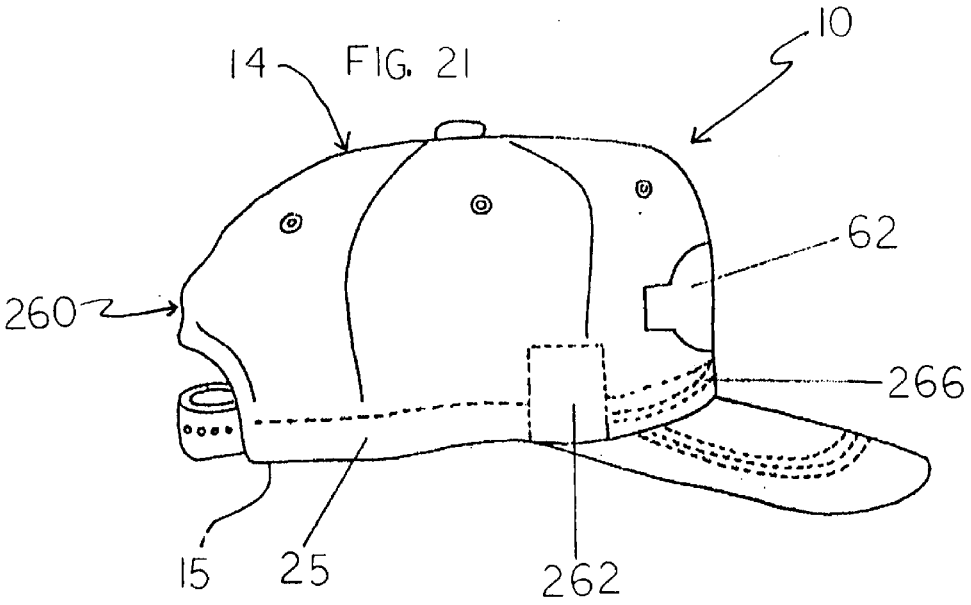
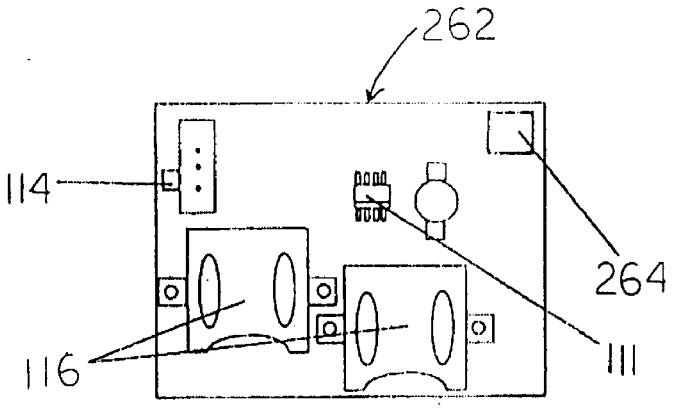
FIG. 22
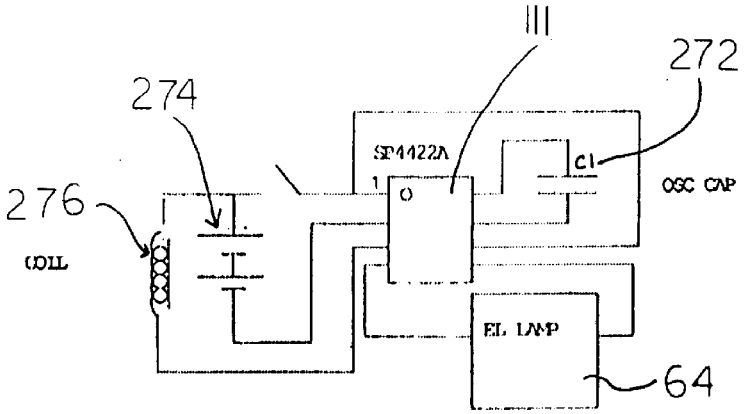
FIG. 23

ILLUMINATED ACCESSORY AND DEVICE

BACKGROUND OF THE INVENTION

1. Field of the Invention

The present invention relates to an illuminated accessory and device and more particularly pertains to providing a lighting arrangement for illumination of hat panels, jewelry, home ornamentation devices and vehicle door signs.

2. Description of the Prior Art

The use of illumination mechanisms are known in the prior art. More specifically, illumination mechanisms heretofore devised and utilized for the purpose of adding light to various accessories and devices are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,452,479 to Mostert discloses a cap with a display pouch. The cap is for covering the head of a person. A structure is for holding a card-like article. A component is for attaching the holding structure to the head covering member.

U.S. Pat. No. 5,485,358 to Chien discloses a universal L.E.D. safety light for head-wear. The lighting mechanism of Chien is made up of several light emitting diodes mounted on a flexible plate. The flexible plate is one of the straps for the length-adjustable belt conventionally provided at the rear of a cap. The LED will light the cap along its peripheral edge.

U.S. Pat. No. 5,404,593 to Kronenberger discloses a headwear piece with ornamental illumination. The headwear piece has a crown that defines a receptacle for the head of a wearer and an illumination structure on the crown. The illuminating structure projects an unfocused light as an adornment to the crown that is visible from external the crown. The illumination structure uses fiber optics operation that is well known to those skilled in the art.

U.S. Pat. No. 5,359,734 to Rathburn discloses a hat with interchangeable display panels. The hat has a vertical wall in which an opening has been made, and a seam formed about the periphery of the opening. One part of a hook-and-pile type fastening means is sewed over the opening. A variety of cloth panels with a name, logo, character, or other message may be attached to the hook-and-pile type fastening means sewed to the hat. There is no illumination provided for the display panels.

U.S. Pat. No. 5,233,703 to Galka discloses headwear with an identification pocket. The visor and head-encircling portion is provided with a identification pocket formed in the visor by upper and lower panels disposed in closely spaced parallel relation to one another. The lower panel is separable from the upper panel to form the entrance for insertion of the identification card into the pocket. The pocket is shallow and there is no room in the pocket to support a battery.

U.S. Pat. No. 5,111,366 to Rife and Willingham discloses a cap having illuminated indicia. The cap displays information on the front thereof. The cap has a front section with an opening. Adjacent the opening is a panel-supporting arrangement configured to receive a panel of transparent material. The panel-supporting arrangement supports the transparent panel adjacent the opening. The transparent panel is illuminated from its edge with bulbs formed of material such as gallium arsenide or light emitting diodes. The present invention is distinguished over Rife's cap with illuminated indicia in a number of different ways.

U.S. Pat. No. 5,497,307 to Bae et al. discloses illuminating jewelry. The jewelry of Bae has a housing that contains a mercury switch, a mercury battery, a cap with a light bulb and a clipping member. The jewelry is clipped onto the wearer's clothing and illuminates anytime the jewelry is moved.

U.S. Pat. No. 5,018,053 to Belknap discloses illuminated jewelry that has an LED light source. The LED light source is molded with non-conducting, light transmissive material, which is preferably faceted to provide multiple reflected images of the illuminated light source. The power source, such as a small battery, is held by a retainer which provides electrical contact with one terminal of the power source.

U.S. Pat. No. 4,638,409 to Berman discloses a switching method and device using a movable battery. A non-conductive housing retains a small battery slidably within a recess in the housing. An electrically conductive clip or plate holds the battery within the recess. Lighted or sounding jewelry or other small items containing an electrical element are applications. Additional positions of the movable power source may control other circuits causing other electrical and electronic effects such as flashing or sequential lights. U.S. Pat. No. 2,854,563 to Catching discloses illuminated jewelry that is lighted by a small electric lamp. These prior art patents do provide illuminated accessories, but none provide an accessory of the type depicted in the present invention.

U.S. Pat. No. 4,425,600 to Barnhart discloses an electroluminescent wrist lamp for night vision environment. The apparatus is for use in the cockpit of an aircraft which provides sufficient illumination to read the cockpit display indicators, controls and charts but does not destroy the pilot's night vision. The casing worn on the wrist contains a microencapsulated electroluminescent phosphorus lamp which is connected through a switch to a power supply, all of which are also contained within the case.

U.S. Pat. No. 4,864,473 to Tokarz and Speck discloses an electroluminescent dome light for a convertible automobile. The lighting element consist of a thin piece of electrically conductive material, which is specially treated with an electroluminescent coating. The element is enclosed in a phosphorous treated laminate which provides structure and diffuses the light emitted, giving it qualities of incandescent light. Two electrical connectors are attached to the element to provide a means for generating an electrical current through the conductive material.

U.S. Pat. No. 4,420,898 to Moses discloses a flat emergency exit sign utilizing an electro-illuminescent lamp. An "EXIT" sign utilizes a flat florescent lamp for illuminating the word "EXIT" through a stencil. The sign also includes a phosphorescent material which cooperates with the stencil to display the word "EXIT" when power to the lamp is cut.

Lastly, U.S. Pat. No. 3,680,237 to Finnerty discloses outdoor illuminated signs. The sign is composed of a front transparent plate, a rear backing plate, a masking material between such plates providing opaque and transparent areas forming sign indicia. The electroluminescent lamp panel between such masking material and the back plate, and means sealing the edges of the sign against moisture entering between the plates, masking material and lamp panel and holding them together as a complete, stable, weatherproof unit.

While these devices fulfill their respective, particular objectives and requirements, the aforementioned patents do not describe an illuminated accessory and device that allows hat panels, jewelry, home ornamentation devices and vehicle door signs to be illuminated in a economical and easy way that is not harmful to the user and is a source of enjoyment.

In this respect, the illuminated accessory and device according to the present invention substantially departs from the conventional concepts and designs of the prior art, and in doing so provides an apparatus primarily developed for the purpose of providing a lighting arrangement for illumination of hat panels, jewelry, home ornamentation devices and vehicle door signs.

Therefore, it can be appreciated that there exists a continuing need for a new and improved illuminated accessory and device which can be used for providing a lighting arrangement for illumination of hat panels, jewelry, home ornamentation devices and vehicle doors. In this regard, the present invention substantially fulfills this need.

SUMMARY OF THE INVENTION

In view of the foregoing disadvantages inherent in the known types of illuminating mechanisms now present in the prior art, the present invention provides an improved illuminated accessory and device. As such, the general purpose of the present invention, which will be described subsequently in greater detail, is to provide a new and improved illuminated accessory and device and method which has all the advantages of the prior art and none of the disadvantages.

To attain this, the present invention essentially comprises a hat. The hat has a crown with a lower rear edge and a lower front edge and an apex. The lower edge of the crown has a flexible adjustable band to allow the crown to snugly fit onto the head of the user. A brim extends outwardly from a lower front edge of the crown. The crown includes a plurality of flexible fabric sections sewn together to form the crown, and a button affixed onto the apex of the crown. The plurality of sections of the crown form a front section, a rear section, and a pair of side sections. The front section of the crown has a pouch attached to an interior side. A pocket is formed in the crown. The pocket has a front wall with a bottom peripheral edge and a pair of side peripheral edges. The bottom peripheral edge is stitchedly attached to a peripheral edge of one of the side sections of the crown. The pair of side peripheral edges have one of the side edges stitchedly attached to a seam of the rear section and the one side section. While another of the side edges is stitchedly attached to a seam of the front section and the one side section. A panel is fixedly attached to the front section of the crown. The panel has indicia formed from a polymer film and adhered to the panel. The panel is formed from a flat electroluminescent lamp that has the shape of the indica and provides illumination to the indicia. The lamp is opaque. The lamp has a ribbon extension extending therefrom with a female connector receiving the ribbon. The female connector is positioned through the front section and interior of the crown. Lastly, an inverter is positioned within the pouch of the crown. The inverter has a male connector at one end for coupling with the female connector of the lamp. The inverter has a switch and battery connector at another end. The battery connector projects through the one side section for coupling with the power source positioned within the pocket of the crown. The inverter is adapted to supply AC line current from the power source to the panel, when the male and female connectors are coupled and the switch being activated, for illumination of the indicia.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated accessory and device which has all of the advantages of the prior art illuminating mechanisms and none of the disadvantages.

It is another object of the present invention to provide a new and improved illuminated accessory and device which may be easily and efficiently manufactured and marketed.

It is a further object of the present invention to provide a new and improved illuminated accessory and device which is of durable and reliable construction.

An even further object of the present invention is to provide a new and improved illuminated accessory and device which is susceptible to a low cost of manufacture with regard to both materials and labor, and which accordingly is then susceptible to low prices of sale to the consuming public, thereby making such illuminated accessory and device economically available to the buying public.

Still yet another object of the present invention is to provide a new and improved illuminated accessory and device which provides in the apparatuses and methods of the prior art some of the advantages thereof, while simultaneously overcoming some of the disadvantages normally associated therewith.

Even still another object of the present invention is to provide a illuminated accessory and device for providing a lighting arrangement for illumination of hat panels, jewelry, home ornamentation devices and vehicle door signs.

Lastly, it is an object of the present invention to provide a new and improved illuminated accessory and device including a hat that has a panel attached to the front section of the crown of the hat. The panel has indicia formed from a silkscreened polymer film overlay. The panel is formed of a flat electroluminescent lamp that has the shape of the indica and provides illumination. The lamp has a ribbon extension to a female connector. Included is an inverter positioned within the pouch of the crown of the hat. The inverter has a male connector at one end to couple with the female connector of the lamp. The inverter is in connection with a switch and power source. The inverter is adapted to supply AC line current from the power source to the panel for illumination of the indicia. Alternative embodiments of the present invention are also enclosed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is in a bottom view of the hat embodiment of the present invention of FIG. 1.

FIG. 4 is an isometric view of the inverter of the hat embodiment of FIG. 1.

FIG. 5 is a front elevational view of the EL-panel of the hat embodiment of FIG. 1.

FIG. 11 is a perspective view of the picture frame embodiment of the illuminated accessory and device constructed in accordance with the principles of the present invention.

FIG. 12 is a cross-sectional view of the frame of FIG. 11.

FIG. 13 is a perspective view of the address sign embodiment of the illuminated accessory and device constructed in accordance with the principles of the present invention.

FIG. 14 is a cross-sectional view of the sign of FIG. 13.

FIG. 15 is a schematic of the LED array of the address light embodiment of the illuminated accessory and device of the present invention.

FIG. 16 is an isometric view of the first panel of the vehicle door sign of the illuminated accessory and device of the present invention.

FIG. 17 is an isometric view of the second panel of the vehicle door sign.

FIG. 18 is an isometric view of the sheet of the vehicle door sign.

FIG. 21 is a side elevational view of an alternative construction of the hat embodiment of the illuminated accessory and device.

FIG. 22 is a rear view of the circuit board of the alternative hat embodiment of FIG. 21.

FIG. 23 is a schematic of the circuit board of FIG. 22 of the alternative hat embodiment.

The same reference numerals refer to the same parts through the various Figures.

DESCRIPTION OF THE PREFERRED EMBODIMENT

Figure 1:
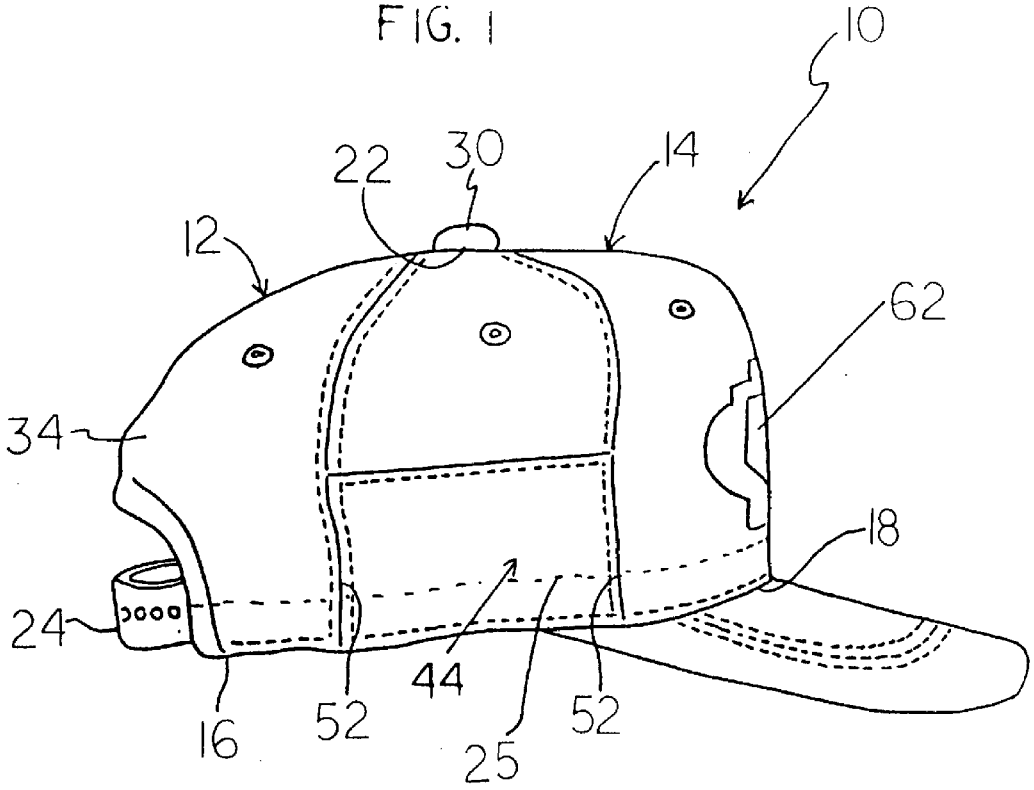
FIG. 1 is a perspective view of the hat embodiment of the illuminated accessory and device constructed in accordance with the principles of the present invention.

With reference now to the drawings, and in particular to FIGS. 1 through 23 thereof, the preferred embodiment of the new and improved illuminated accessory and device embodying the principles and concepts of the present invention and generally designated by the reference numeral 10 will be described.

The present invention, the illuminated accessory and device is comprised of a plurality of components. Such components in their broadest context include a polymer overlay, a panel and an inverter. Such components are individually configured and correlated with respect to each other so as to attain the desired objective.

Figure 2:
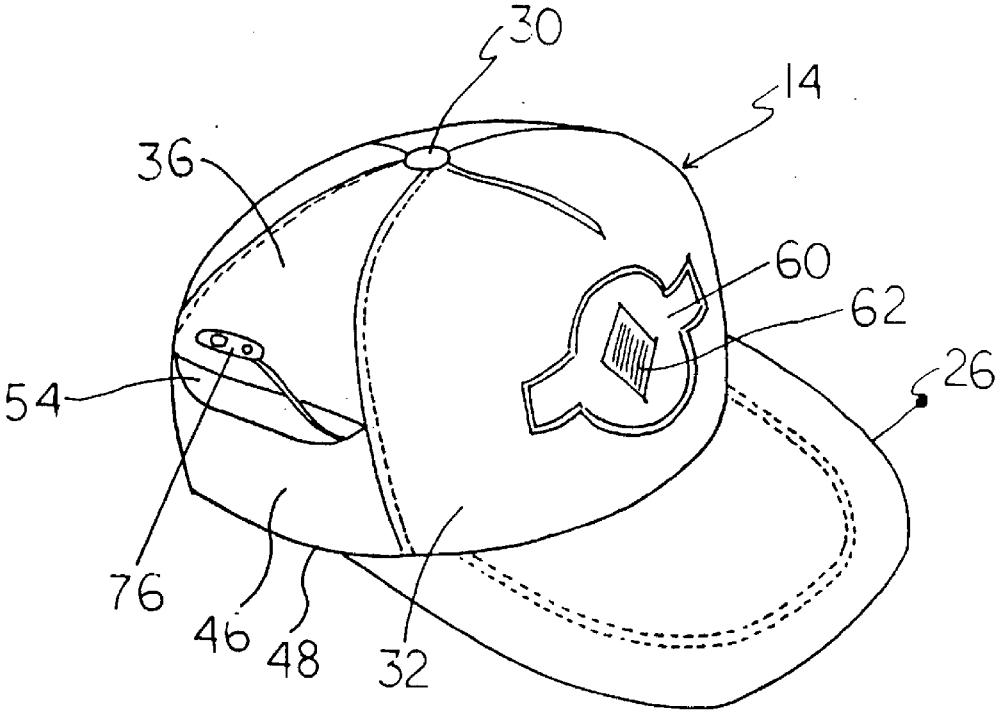
FIG. 2 is an isometric view of the hat embodiment in an operable orientation.

Specifically, the present invention includes a hat 12 that has a crown 14 with a lower edge 15. The lower edge has a lower rear edge 16 and a lower front edge 18 and an apex 22. The lower rear edge of the crown has a flexible adjustable band 24 that allows the crown to snugly fit onto the head of the user. Extending from the lower edge and within the hat is a sweat band 25. In FIG. 2, a brim 26 is shown to extend outwardly from the lower front edge of the crown. The crown includes a plurality of flexible fabric sections sewn together to form the crown.

Also, a button 30 is affixed onto the apex of the crown. The plurality of sections of the crown form a front section 32, a rear section 34, and a pair of side sections 36. The front section of the crown has a pouch 38 attached to the interior side.

Additionally, a pocket 44 is formed in one of the side sections 36 of the crown 14. The pocket has a front wall 46 with a bottom peripheral edge 48 and a pair of side peripheral edges 52. The bottom peripheral edge is stitchedly attached to a peripheral edge of one of the side sections of the crown, as shown in FIG. 1. The pair of side peripheral edges have one of side edges stitchedly attached to a seam of the rear section and the one side section. Another of the side edges is stitchedly attached to a seam of the front section and the one side section. The pocket has an opening 54 spaced from the bottom peripheral edge. The opening allows the user easy access for placement and removal of the items within the pocket.

As best illustrated in FIG. 2, a panel 60 is fixedly attached to the front section 32 of the crown 14. The panel has indicia 62 formed from a silk-screen polymer film overlay adhered to the panel. The polymer film is preferably a vinyl. The indicia may be in the form of a name, logo or character. The panel is formed of a flat electroluminescent lamp 64 that has the shape of the indicia and provides illumination to the indicia. FIG. 5 shows the general shape of the lamp prior to being cut.

The lamp is the commercially available electroluminescent lamp (EL-lamp) that is formed by a phosphorous coating screened onto a metal substrate and encased in a clear laminating material. The lamp is opaque and the phosphorous coating reacts to electricity from the battery to illuminate the overlaid indicia. The light behind the indicia, as a result of the phosphorous, has an incandescent light quality. The lamp has a ribbon extension 66 coupled to a female connector 68. The female connector is positioned through the front section 32 and interior the crown, as shown in FIG. 3.

Lastly, an inverter 70 is positioned within the pouch 38 of the crown. The inverter, as shown in FIG. 4, has a male connector 72 at one end to couple with the female connector of the lamp. The inverter has a switch 74 and battery connector 76 at another end. The battery connector has wires 78 that project through the one side section 36 for coupling with a power source. The power source is a standard DC battery that can be positioned within the pocket 44 of the crown. The inverter is adapted to supply alternating current (AC) line current from the power source to the panel, when the male and female connectors are coupled and the switch is activated, for illumination of the indicia 62.

Figure 6:
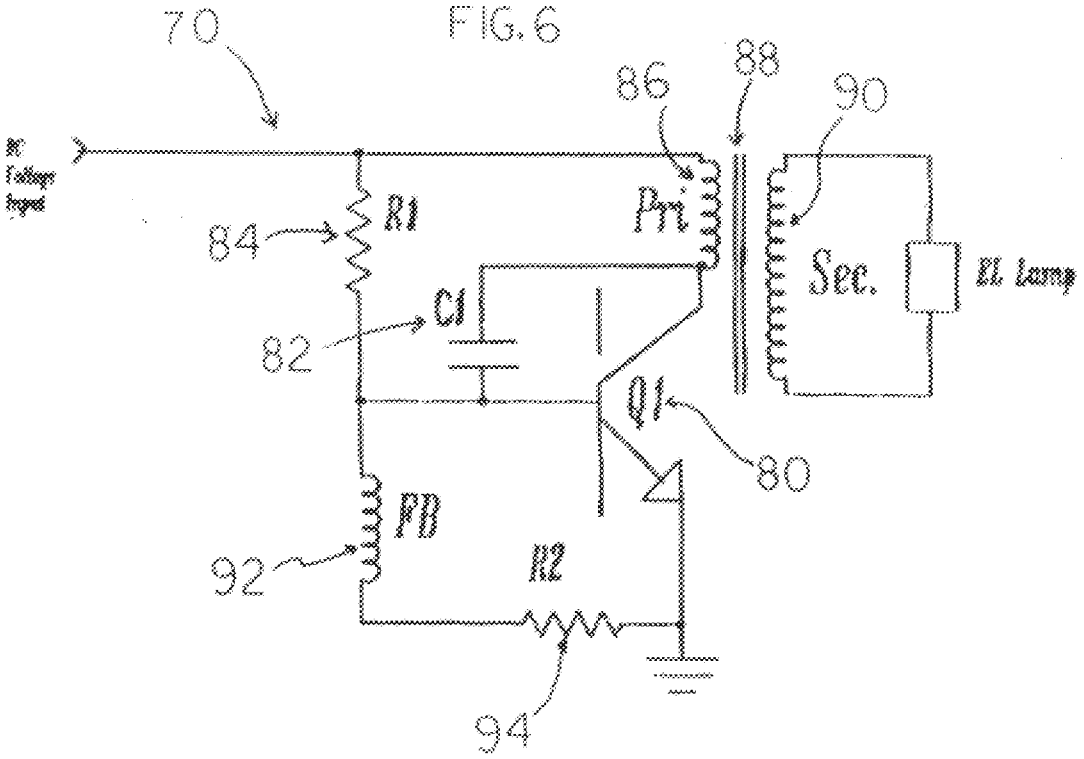
FIG. 6 is a schematic of the hat embodiment of the illuminated accessory and device of the present invention.

As best shown in FIG. 6, the inverter 70, of the lamp for the hat, comprises a transistor Q1 80. The transistor has a collector terminal, a base terminal, and an emitter terminal. A capacitor C1 82 is coupled between the collector terminal and the base terminal of the transistor. Also included is a first resistor 84 coupled between a first terminal of the battery and the base terminal of the transistor for supplying DC power to the inverter. A primary coil 86 of a transformer 88, with a predetermined amount of coils, is coupled between the first resistor and the collector terminal of the transistor thus completing an RC circuit defined by the first resistor and the capacitor.

Associated with the primary coil is a secondary coil 90 with a number of coils greater than that of the primary coil. The transformer is thus of a step-up type. A series combination of an inductor FB 92 and a second resistor R2 94 are connected between the base terminal and the emitter terminal of the transistor. It should be noted that a second terminal of the battery and the emitter terminal of the transistor are grounded. Finally, the electroluminescent lamp 60 is coupled to the secondary coil of the transformer for receiving an augmented alternating current from the inverter thus allowing the illumination thereof.

Figure 9:
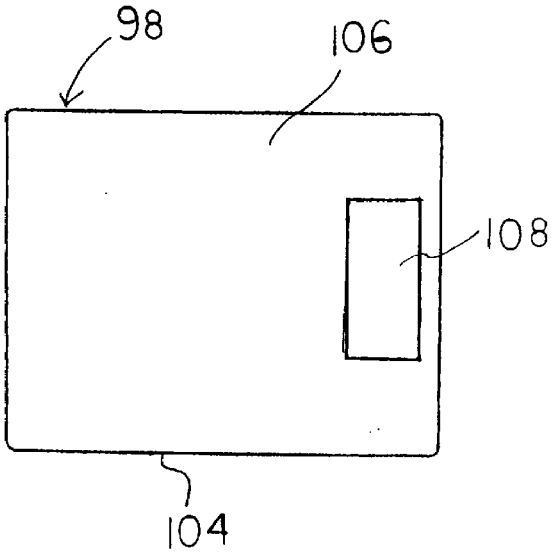
FIG. 9 is a rear view of the supporting member of the lapel pin embodiment of the illuminated accessory and device.

In a fashion like the hat logo, a lapel pin 96 may be illuminated. The lapel pin has a supporting member 98, a polymer film overlay 100 and a printed circuit board 102. The supporting member, as depicted in FIG. 9, is formed of a flat electroluminescent lamp 64 of the same type used in the panel 60 attached to the hat. The supporting member has a front side 104 and a rear side 106. The rear side of the supporting member has a compression contact 108. The compression contact is attached to the rear side and adjacent the side edge of the support member. The electroluminescent lamp is opaque and can be a variety of colors.

Figure 8:
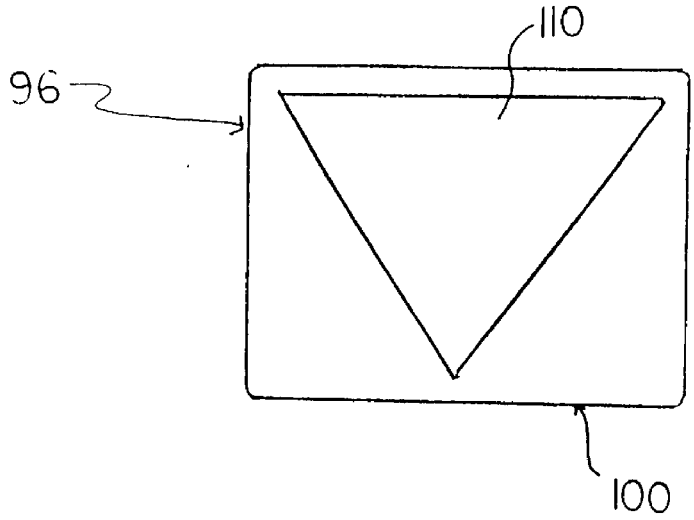
FIG. 8 is a rear view of the overlay of the lapel pin embodiment of the illuminated accessory and device.
Figure 10:
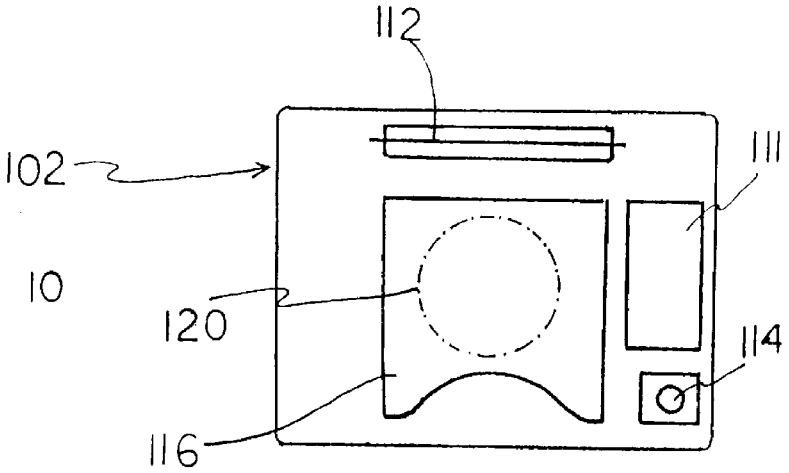
FIG. 10 is a rear view of the circuit board of the lapel pin of the illuminated accessory and device.

The polymer film overlay 100 is preferably a vinyl that is sized to be disposed over the front side of the supporting member 98. The film of FIG. 8 is translucent. The polymer film overlay has indicia 100 silk-screened onto the film. As shown in FIG. 10, the printed circuit board 102, is sized to be disposed onto the rear side of the supporting member.

Attached to the circuit board has an inverter 111, a clipping member 112, a switch 114 and a battery holder 116. The circuit board and the supporting member are adhered together to allow the inverter to make contact with the compression contact. The circuit board 102, provides support for the supporting member with the overlay 100. The supporting member, the film overlay and the circuit board are coupled together with an adhesive. When the lapel pin is formed a battery is placed within the battery holder 116. The battery is a lithium battery 120.

When the switch is turned on, an alternating current line current flows from the holder to the inverter and into the compression contact. The current activates the supporting member. Once the supporting member is activated the indicia is illuminated. The lapel pin may be clipped onto wearing apparel and secured with the clipping member 112. The lapel pin circuit board can also support a blinker chip 122. The blinker chip will allow the lamp to go on and off to give the pin a strobe effect.

Figure 7:
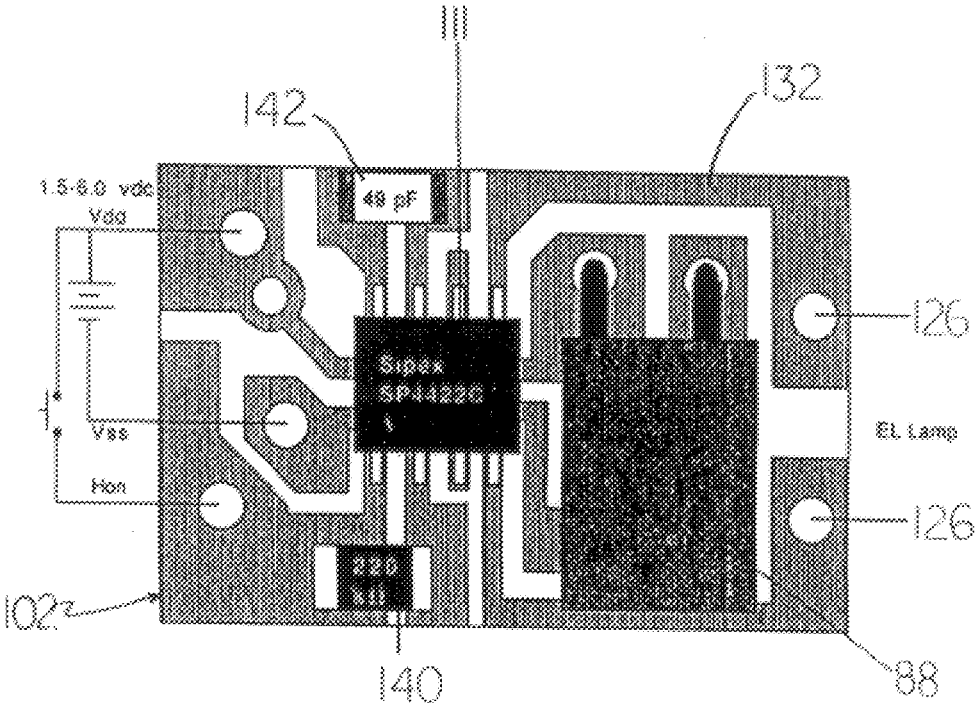
FIG. 7 is a schematic of the circuit board of the lapel pin embodiment of the illuminated accessory and device of the present invention.

As best illustrated in FIG. 7, the inverter for the lapel pin is a micro-inverter 111, with identical circuit components of FIG. 6. The inverter has contact points L26. The inverter is embedded on the small circuit board 102. The circuit board has a top surface 132 and a bottom surface unlabeled. This allows the utilization thereof with the small electroluminescent lamp associated with the lapel pin. Such circuit board affords both the containment of the electronic components and further provides a unique coupling with the electroluminescent lamp. The coupling preferably includes the compression contact 108 of the electroluminescent lamp/supporting member and the pair of contact points 126 formed in the bottom surface of the circuit board near a side edge. As such, the electroluminescent lamp may be situated contiguous with the circuit board upon the electrical coupling. A conductive adhesive is utilized to provide additional securement between the electroluminescent lamp and the circuit board.

In lieu of the battery shown in FIG. 6, a 20 mm battery is utilized which provides approximately 3V. The specially adapted battery holder secures the battery to the circuit board. To accommodate the proper alternating current required by the electroluminescent lamp, a 220 OHM 140 resistor is employed in conjunction with a 49 pica-Farad capacitor 142.

Another illuminated device is a frame 150. The frame is sized to receive a picture 152. The frame has base panel 154 and a border 156 that is positioned adjacent a peripheral edge 158 of the base panel. The frame may come in various sizes. The border is capable of defining a display area for the picture. The border is capable of retaining the picture within the frame. The picture is formed from a transparency type material.

Included in the frame is a lighting arrangement 162 formed of a pair of sub-miniature fluorescent lamps 164. The lamps, as shown in FIG. 12, are cold cathode fluorescent lamps that are 7 mm in diameter. Each lamp is retained above an inside surface 168 of the base panel with a pair of axial base members 170. The axial base members are fixedly attached to the inside surface of the base panel. The pair of sub-miniature fluorescent lamps are adapted to provide illumination to the picture of the frame. The sub-miniature fluorescent lamps have a high triphosphor coating for high lumen output.

Additionally, an inverter 172 is attached to the inside surface of the base panel of the frame. The inverter is adapted to be in electrical communication with the axial base members of the fluorescent lamps. Also, the inverter is adapted to received power from a low voltage power source. The low voltage power source is an adapter with a step down type transformer to reduce the standard 110 AC house current. The inverter is capable of supplying alternating current line current for powering up the fluorescent lamps to illuminate the picture within the frame.

An additional device that is included with the present invention is an illuminated house address 180. The house address has a generally rectangular housing 182. The housing has a front wall 184, a rear wall 186 and peripheral edges 188. The housing is formed of an acrylic that is semi-translucent white.

Included is a rectangular overlay 192, as shown in FIG. 13. The overlay is adhered to the front wall 184 of the housing. The overlay is a vinyl material. The vinyl material is preferably black but may be any color. The overlay has numerals 194 formed therein by openings being cut through the vinyl material. The acrylic is painted on the front wall, rear wall and peripheral edges. The area of the front wall, under the plate, remains paint free.

Also, a lighting arrangement 198 is positioned within the housing 182. The lighting arrangement is formed by an LED array or a subminiature fluorescent lamp. As, depicted in FIGS. 14 and 15, the lighting array is an LED array 200 that is capable of illuminating the numerals of the overlay 192.

A support strip 202 is provided. The LED array is mounted to the support strip, as seen in FIG. 14. The support strip of the LED array is attached to the rear wall 186 of the housing.

Lastly, an inverter 206 is attached to the inside surface of the rear wall of the housing and spaced from the support strip 202. A wire harness 208 is passed through the support strip and coupled to the inverter and the LED array. The inverter has a light sensor 210 and is connected to the existing alternating current line current coming from within a house. Between the inverter and the line current coming from the housing is a transformer.

The transformer is a low-voltage adapter from the house wall outlet to the address light. The transformer is a step down transformer to reduce the standard 110 AC house current. The transformer is capable of converting alternating current from the house to direct current. The inverter, when powered up, is capable of allowing the LED array to illuminate the numerals of the front plate of the housing when the light sensor, therein, no longer detects sunlight. The LED array is unilluminated when the light sensor of the inverter detects sunlight.

Furthermore, as shown in the FIG. 15, the led array comprises four banks of diodes 214 connected in parallel. Each bank comprises ten diodes connected in series. A plurality of resistors 216 are each coupled in series with an associated bank of diodes. Ideally, such resistors are rated at a ½ watt and have a resistance of 47 OHMS. Further included is a bridge rectifier 218 coupled to a capacitor 220 which, in turn, is connected in parallel with the banks of diodes. Preferably, the capacitor has a capacitance of 22 uF and is of an electrolytic type. The present invention thus may be supplied with alternating current from a conventional receptacle when the connector 222 couples with the inverter 206. Upon the receipt of power, the bridge rectifier rectifies the associated current. The capacitor then works in conjunction with the resistors and diodes in order to both filter and regulate the rectified current thereby affording direct current for powering the diodes.

Figure 19:
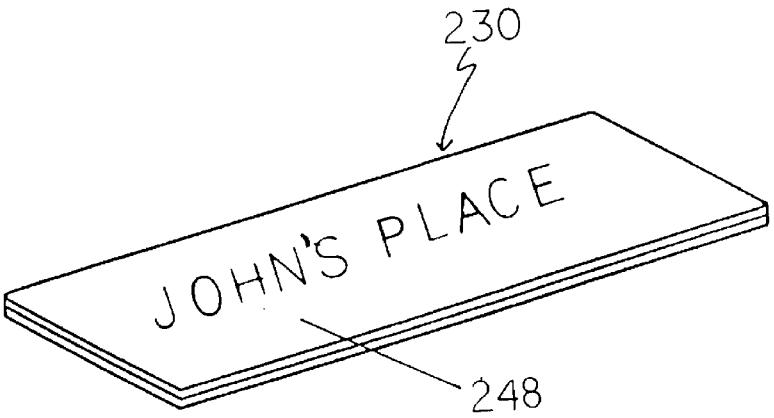
FIG. 19 is a perspective view of the vehicle door sign of the present invention.
Figure 20:
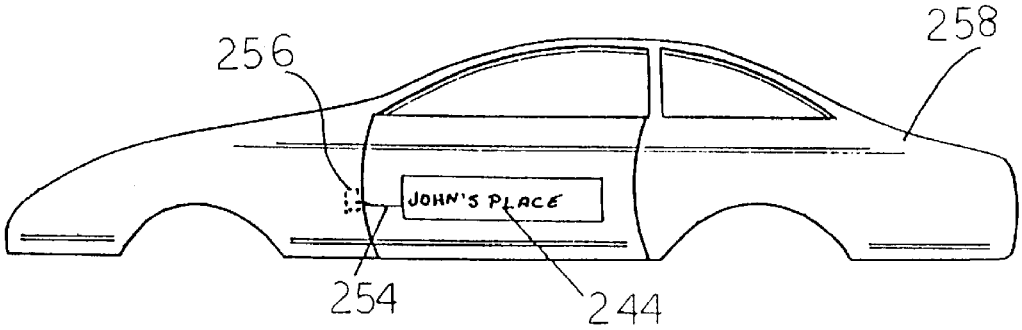
FIG. 20 is the vehicle door sign of the present invention in an operable configuration.

A final device of the present invention is an illuminated vehicle door sign/nite-sign, as shown in FIG. 19. The vehicle door sign 230 has a generally rectangular sheet 232, a first panel 234 and a second panel 236. The sheet is formed of a magnetic material that allows it to be coupled with the door of a vehicle. As seen in FIG. 18, the sheet has a top surface 238 with an adhesive 242.

As best illustrated in FIG. 16, the first panel 234 is sized for positioning onto the top surface of the rectangular sheet 232. The first panel is a polymer film overlay with indicia 244 silk-screened onto the film. The polymer film is preferably a clear vinyl that will accommodate any design or color. The first panel has film and an upper surface 248 and a lower surface. The upper surface has indicia silk-screened thereon.

The second panel 236, as seen in FIG. 17, is formed of a flat electroluminescent lamp 64. The lamp is identical to the lamp used in the devices set out above in this application. Attached to the lamp is a ribbon extension 252 that is connected to a female connector 254. The second panel is sized for disposing between the first panel 234 and the rectangular sheet 232. The second panel is adhered to the first panel and the second panel is adhered to the rectangular sheet to form the vehicle door sign/nite-sign 230. The second panel provides illumination to the indicia 244 of the first panel.

Lastly, an inverter 256 is positioned within a vehicle 258. The inverter couples with the female connector 254 that extends from the vehicle door sign. The inverter is adapted to supply alternating line current from within the vehicle 258 to the vehicle door sign when the female connector is coupled. The sheet allows the vehicle door sign to be removably coupled to the vehicle door. Supplying the inverter with electrical current allows the second panel to be illuminated for the illumination of the indicia when the vehicle door sign is in position.

In FIG. 21, an alternative hat 260 embodiment is depicted. This hat is much like the hat 12 of FIG. 1. The alternative hat 260 does not have the pocket of FIG. 1. The alternative hat has a crown 14, a lower edge 15 and a sweat band 25. Attached to the front section of the crown in the panel formed of the flat electroluminescent lamp 64. The panel has indicia 62 formed from a silk-screen polymer film overlay. This panel of the alternative hat embodiment is in electrical communication with a small circuit board 262. The small circuit board of this embodiment is similar to the circuit board of the lapel pin.

The circuit board 262, as seen in FIG. 22, has a connector tab 264, a micro inverter 111, a switch 114 and a pair of battery holders. The battery holders each will support the power source. Two 3VDC coin cell batteries are the preferred power source and one each is sized for positioning within one of the battery holders. The circuit board is connected to the panel by way of wires 266 that extend from the panel and couple with the connector tab 264. Once the circuit board and panel are in electrical communication, the circuit board is positioned within the sweat band 25 of the hat 260. The sweat band of the hat will support the circuit board during operation of the panel.

Additionally, the schematic of the circuit board is best illustrated in FIG. 23. The inverter 111 is in communication with a capacitor 272, the panel 64, the power sources 274 and an inductor coil 276. The capacitor is coupled solely to the inverter. The inverter is coupled between the capacitor and the power source. The inductor coil, with a predetermined amount of coils, is coupled between the inverter and the switch and the power source thus completing the circuit.

The alternative embodiment hat 260 is illuminated. The panel is identical to the panel in hat 12 in that it will illuminate the indicia. The difference between the two hat embodiments is the system by which the panel receives the necessary current. In the alternative embodiment when the switch is turned on an alternating current line current flow from the holders to the inverter and into the contact. The current activates the panel and the indica is illuminated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved illuminated accessory and device comprising in combination:

a hat having a crown with a lower rear edge and a lower front edge and an apex, the lower rear edge of the crown having a flexible adjustable band to allow the crown to snugly fit onto the head of the user, a sweat band extending from the lower edge and within the hat and a brim extending outwardly from the lower front edge of the crown, the crown including a plurality of flexible fabric sections sewn together to form the crown, and a button affixed onto the apex of the crown, the plurality of sections of the crown forming a front section, a rear section, and a pair of side sections, the front section of the crown having a pouch attached to an interior side thereof;

a pocket formed in the crown and having a front wall, the front wall having a bottom peripheral edge and a pair of side peripheral edges, the bottom peripheral edge being stitchedly attached to a peripheral edge of one of the side sections of the crown, the pair of side peripheral edges having one of the side edges stitchedly attached to a seam of the rear section and the one side section, while another of the side edges being stitchedly attached to a seam of the front section of the one side section, the pocket having an opening spaced from the bottom peripheral edge for allowing access to the pocket;

a panel being fixedly attached to the front section of the crown, the panel having indicia formed from a silk-screen polymer film including vinyl overlay adhered thereto, the panel being formed of a flat electroluminescent lamp having the shape of the indica and providing illumination thereto, the lamp being opaque, the lamp having a ribbon extension with a female connector, the female connector being positionable through the front section and interior of the crown, wherein the electroluminescent lamp is formed by a phosphorous coating screened onto a metal substrate and encased in a clear laminating material, the lamp reacting to electricity by illuminating as a result of an incandescent property of the phosphorous; and an inverter positioned within the pouch of the crown, the inverter having a male connector at one end for coupling with the female connector of the lamp, the inverter having a switch and battery connector at another end, the battery connector capable of projection through the one side section for coupling with a power source, the inverter adapted to supply alternating line current from the power source to the panel, when the male and female connectors are coupled and the switch being activated, for illumination of the indicia;

said the inverter including a transistor having a collector terminal, a base terminal, and an emitter terminal, the inverter further including a capacitor coupled between the collector terminal and the base terminal of the transistor, a first resistor coupled between a first terminal of the battery and the base terminal of the transistor for supplying DC power to the inverter, a primary coil of a transformer with a predetermined amount of coils coupled between the first resistor and the collector terminal of the transistor thus defining an RC circuit with the first resistor and the capacitor, a secondary coil with a number of coils greater than that of the primary coil, and a series combination of an inductor and a second resistor connected between the base terminal and the emitter terminal of the transistor, wherein a second terminal of the battery and the emitter terminal of the transistor are grounded, the secondary coil of the transformer connected to the lamp for allowing the illumination thereof.

* * * * *